US008131178B2

(12) United States Patent
Swantner et al.

(10) Patent No.: US 8,131,178 B2
(45) Date of Patent: Mar. 6, 2012

(54) IMAGE FORMING SYSTEM CLEANING STATION WITH WASTE TONER COLLECTION

(75) Inventors: Richard L. Swantner, Boise, ID (US); Sarah Elizabeth Swantner, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 387 days.

(21) Appl. No.: 12/465,946

(22) Filed: May 14, 2009

(65) Prior Publication Data

US 2010/0290805 A1 Nov. 18, 2010

(51) Int. Cl.
*G03G 15/16* (2006.01)

(52) U.S. Cl. ..... 399/101; 399/129

(58) Field of Classification Search ..... 399/101, 399/129

See application file for complete search history.

(56) References Cited

U.S. PATENT DOCUMENTS

| | | | | |
|---|---|---|---|---|
| 6,259,883 | B1 | 7/2001 | Tsunoda et al. | |
| 6,621,996 | B1 | 9/2003 | Meyer et al. | |
| 6,856,777 | B2 * | 2/2005 | Enomoto et al. | 399/128 |
| 7,095,974 | B2 | 8/2006 | Yoshino et al. | |
| 7,224,930 | B2 | 5/2007 | Oda et al. | |
| 7,313,336 | B2 | 12/2007 | Kadota et al. | |
| 7,713,670 | B2 * | 5/2010 | Tomita et al. | 430/110.3 |
| 2003/0053820 | A1 * | 3/2003 | Enomoto et al. | 399/128 |
| 2005/0260516 | A1 * | 11/2005 | Tomita et al. | 430/110.3 |
| 2006/0024102 | A1 | 2/2006 | Jung | |
| 2006/0078361 | A1 | 4/2006 | Park | |
| 2007/0050518 | A1 * | 3/2007 | Yamade | 709/238 |
| 2008/0008481 | A1 | 1/2008 | Takahashi et al. | |
| 2008/0152387 | A1 | 6/2008 | Kubo | |
| 2008/0187369 | A1 * | 8/2008 | Nakagawa et al. | 399/310 |
| 2008/0253807 | A1 * | 10/2008 | Soda | 399/175 |
| 2009/0232530 | A1 * | 9/2009 | Saito et al. | 399/50 |

FOREIGN PATENT DOCUMENTS

| | | | |
|---|---|---|---|
| CN | 101206436 | A | 6/2008 |
| DE | 10033745 | A1 | 2/2001 |
| EP | 1265116 | A2 | 12/2002 |
| JP | 2003150013 | A | 5/2003 |
| JP | 2004021134 | A * | 1/2004 |
| JP | 2007025266 | A | 2/2007 |

* cited by examiner

*Primary Examiner* — David Gray
*Assistant Examiner* — G. M. Hyder

(57) ABSTRACT

A cleaning station is usable with an image forming apparatus that has at least one developer configured to deliver toner of a first polarity to a latent image formed on a photoconductor. The cleaning station includes a transfer mechanism configured to transfer the toner of the first polarity from the latent image to a print medium, a charging station configured to charge waste toner not transferred from the transfer mechanism to the print medium to a second polarity opposite the first polarity, and a cleaner assembly configured to collect the waste toner from the transfer mechanism.

12 Claims, 5 Drawing Sheets

IMAGE FORMING SYSTEM CLEANING STATION WITH WASTE TONER COLLECTION

BACKGROUND

A printer system may include an image forming apparatus having a photoconductor, an exposure source directed toward the photoconductor, and toner configured for developing an image. In one example of an image forming apparatus, a latent image is formed on the photoconductor by a laser (or other exposure source), and the latent image is developed with the toner prior to transfer of the toner/image to a print medium by a transfer mechanism. With some image forming devices, heat and pressure are used to fuse the toner/image onto the print medium.

Exemplary image forming devices may be configured to cycle in a loop where the transfer mechanism is provided as a belt or a drum. In any regard, some amount of toner invariably remains on the image transfer mechanism. The toner that is not transferred from the transfer mechanism is thus un-utilized (or under-utilized or waste), and this waste toner can lead to a build up of unused toner on the transfer mechanism that can undesirably affect image quality on the print medium.

For these and other reasons, a need exists for the present invention.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

Embodiments provide a cleaning station or cleaner assembly for use with an image printing system, where the cleaning station or cleaner assembly is configured to reclaim unused toner or waste toner from a transfer mechanism of the image printing system and recycle or re-use the reclaimed waste toner for printing images or lubricating other components in the image printing system.

In this specification, "polarity" means the electrical state of a charged entity (e.g., a particle or a compound), where the electrical state is characterized as one of a positive charge or a negative charge.

Figure 1:
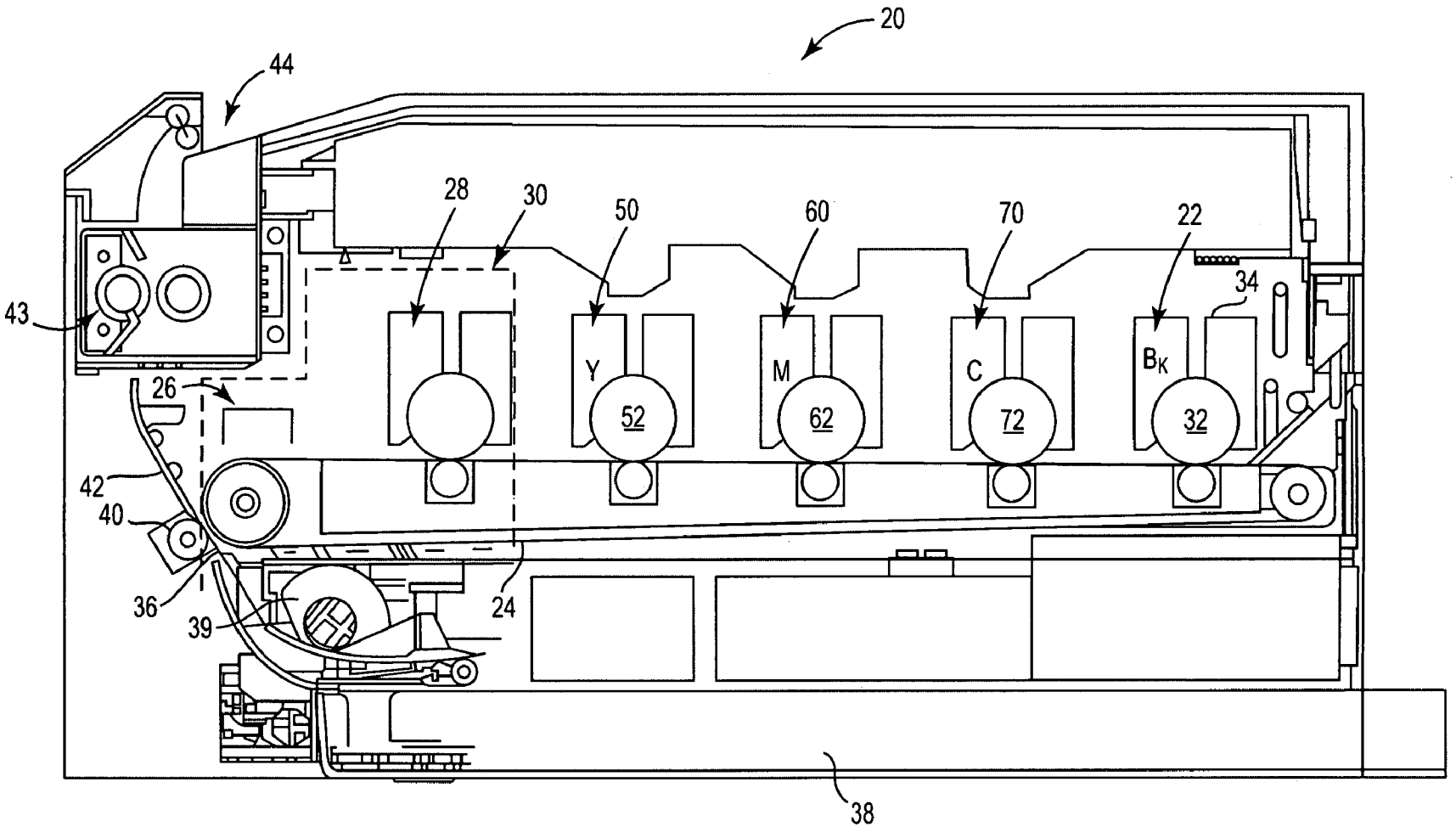
FIG. 1 is a schematic cross-sectional side view of an image printing system including a cleaner assembly according to one embodiment.

FIG. 1 is a schematic cross-sectional view of an image printing system 20 according to one embodiment. Image printing system 20 includes at least one developer assembly, such as developer assembly 22, a transfer mechanism 24, a charging station 26, and a cleaner assembly 28 or draft cartridge 28. In one embodiment, transfer mechanism 24, charging station 26, and cleaner assembly 28 combine to provide a cleaning station 30.

In one embodiment, image printing system 20 is provided as a monochromatic printing system and includes one developer assembly, such as developer assembly 22 and cleaning station 30. In one embodiment, developer assembly 22 includes a photoconductor 32 configured to receive a latent image from an exposure source (such as a laser, not shown), and a developer 34 that is configured to deliver toner of a first polarity (82 in FIG. 2) to the latent image formed on photoconductor 32. In one embodiment, photoconductor 32 is a photoconductive drum.

In one embodiment, transfer mechanism 24 is configured to transfer the toner of the first polarity received from developer 34 to a print medium 36, such as a sheet of paper or other printable medium. Suitable transfer mechanisms include a belt, a continuous belt, or a drum, as examples. In one embodiment, print medium 36 is stored in a stack within a tray 38 until it is selectively fed by pick mechanism 39 across a transfer roll 40 where the toner of the first polarity is transferred to print medium 36. Thereafter, print medium 36 is directed along a media path 42 through a fuser 43 and moved to an output tray 44 of image printing system 20. In one embodiment, the toner of the first polarity is not completely transferred to print medium 36, thus leaving a remaining portion of the toner and/or possibly other constituents on transfer mechanism 24. The remaining toner or other constituents is referred to as waste toner. Waste toner includes toner that is not transferred to print medium 36 and other constituents such as paper fibers, paper additives, paper coatings, or debris or particles such as calcium carbonate. Embodiments described herein provide a cleaning station 30 configured to clean the waste toner constituents from transfer mechanism 24.

In one embodiment, charging station 26 is configured to charge the waste toner (82*b* in FIG. 2) to a second polarity that is opposite the first polarity of the toner (82 in FIG. 2) delivered by developer 34. For example, in one embodiment the toner delivered from developer 34 is negatively charged and is electrostatically attracted to transfer mechanism 24, which is positively charged. After transfer of toner 82 to print medium 36, the non-transferred waste toner 82*b* may have a positive charge or include some particles of toner at a negative charge that have failed to transfer to the print medium 36. Charging station 26 is configured to charge waste toner 82*b* to a polarity opposite from the first polarity for subsequent removal by cleaner assembly 28.

In one embodiment, cleaner assembly 28 is configured to accomplish at least one of two functions: selectively transfer the waste toner downstream from cleaner assembly 28 to, for example, developer assembly 22 for lubrication and/or image printing; or remove the waste toner from transfer mechanism 24 and store it in a hopper within cleaner assembly 28 for subsequent use as lubrication or printing, as described herein. In one embodiment, cleaner assembly 28 is configured to print images with waste toner and includes a photoconductor configured to receive a latent image from an exposure source and a developer that is configured to deliver toner to the latent image formed on the photoconductor (See FIG. 3).

In one embodiment, developer assembly 22 is provided as one of multiple developer assemblies. For example, in one embodiment, developer assembly 22 is provided with black (Bk) toner and is configured for printing and imaging monochrome images, and is provided along with other developer assemblies such as a developer assembly 50 having a photoconductor 52, a developer assembly 60 having a photoconductor 62, and a developer assembly 70 having a photoconductor 72. In one embodiment, photoconductors 32, 52, 62, 72 are organic photoconductors. In one embodiment, image printing system 20 is provided as a color laser printer and developer assembly 50 includes yellow (Y) toner, developer assembly 60 includes magenta (M) toner, and developer assembly 70 includes cyan (C) toner configured to develop color images in combination with the black toner provided by developer assembly 22.

As such, each developer assembly 22, 50, 60, 70 includes a respective photoconductor 32, 52, 62, 72 that is configured to receive a latent image from a laser or exposure device and a developer cartridge configured to deliver toner onto the latent image for development of an image onto print medium 36.

Figure 2:
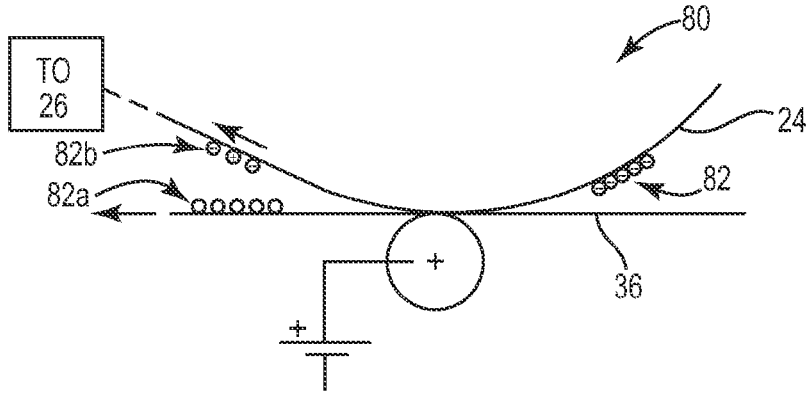
FIG. 2 is a schematic cross-sectional view of a transfer mechanism employed to transfer an image to a print medium prior to entering the cleaner assembly illustrated in FIG. 1 according to one embodiment.

FIG. 2 is a schematic cross-sectional view of a transfer process 80 employed with image printing system 20 (FIG. 1) according to one embodiment. Transfer process 80 includes depositing toner 82 onto transfer mechanism 24, where toner 82 is suitably delivered from any one or more of developer assemblies 22, 50, 60, 70, or cleaner assembly 28. As described in greater detail below, toner 82 is electrostatically charged to a first polarity (for example to a net negative charge) and retained electrostatically on transfer mechanism 24. During transfer process 80, at least a portion of toner 82 is transferred to print medium 36. For example, a first portion 82*a* of toner 82 is transferred to print medium 36 and a remaining portion 82*b* of toner 82 (e.g., waste toner 82*b*) remains on transfer mechanism 24. Embodiments described herein provide a system and a method for removing/recycling/reusing waste toner 82*b* from transfer mechanism 24.

Figure 3:
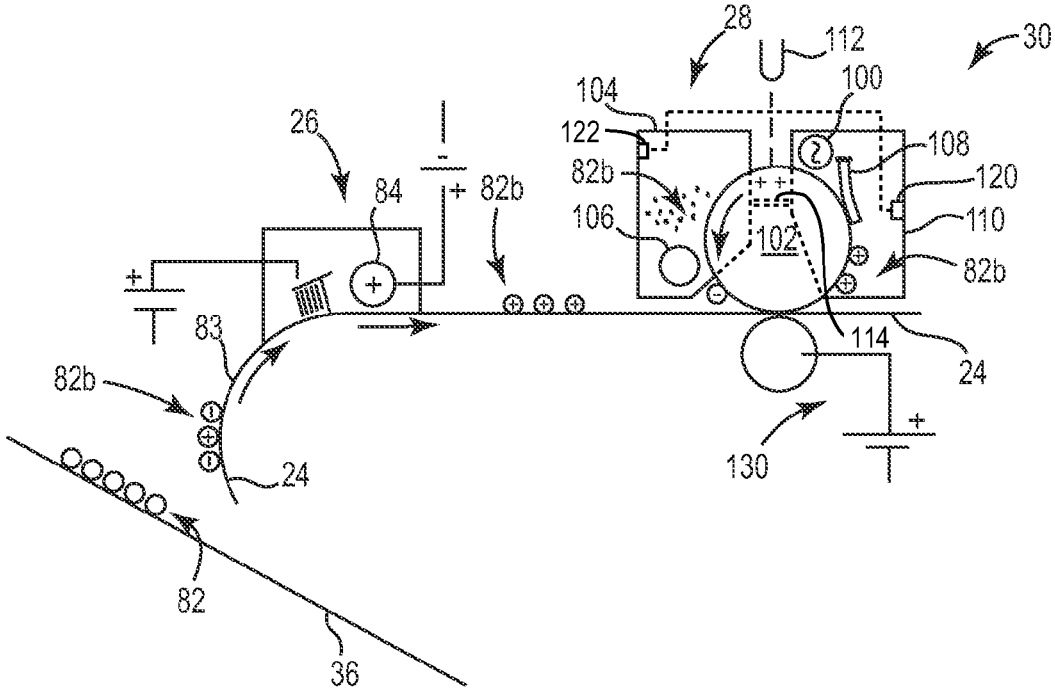
FIG. 3 is a schematic cross-sectional view of the cleaner assembly illustrated in FIG. 1 according to one embodiment.

FIG. 3 is a schematic cross-sectional view of cleaning station 30 according to one embodiment. Cleaning station 30 includes transfer mechanism 24 having waste toner 82*b* on a surface 83, charging station 26 configured to electrostatically charge waste toner 82*b*, and cleaner assembly 28.

In one embodiment, toner 82 is charged to a first polarity (for example a negative charge) and waste toner 82*b* includes the portion of toner 82 that was charged negative but did not transfer to medium 36, or the portion of toner 82 that was that was charged positive and did not transfer to medium 36, or the portion of toner 82 that for another reason did not transfer to medium 36. That is to say, waste toner 82*b* can include toner particles having a positive charge and toner particles having a negative charge.

In one embodiment, charging station 26 is configured to uniformly charge waste toner 82*b* to a second polarity that is opposite the first polarity to which toner 82 was charged. For example, in one embodiment, toner 82 is charged negative for transferring onto print medium 36, and waste toner 82*b* is charged positive by charging station 26. In this regard, charging station 26 is illustrated as including a positive bias 84, although it is to be understood that the electrostatic bias delivered by bias 84 could be negative in the case where toner 82 is delivered to transfer mechanism 24 with a positive charge. With this understanding, waste toner 82*b* leaving charging station 26 and entering cleaner assembly 28 generally is charged at the second polarity that is opposite the first polarity of toner 82.

In one embodiment, cleaner assembly 28 includes a conductor 100, a draft photoconductor 102, a draft developer 104 including a developer roller 106, a cleaning blade 108, and a hopper 110. Cleaner assembly 28 is configured to collect waste toner 82*b* from transfer mechanism 24 and store/retain waste toner 82*b* within hopper 110.

In one embodiment, cleaner assembly 28 is configured to remove waste toner 82*b* from transfer mechanism 24 and collect waste toner 82*b* within a portion or housing of cleaner assembly 28. In one embodiment, cleaner assembly 28 is configured to enable waste toner 82*b* to remain on transfer mechanism 24 and be transported to one of the developer assemblies 50, 60, 70, 22 (FIG. 1).

In one embodiment, cleaner assembly 28 is configured for printing images using waste toner 82*b*. In one embodiment, conductor 100 is employed to impart a charge (e.g., a negative charge) onto draft photoconductor 102. A laser 112 or other exposure device is employed to draw or expose a latent image onto draft photoconductor 102. Those areas on draft photoconductor 102 that receive the latent image become relatively positive charged after exposure by laser 112. Draft developer 104 provides negatively charged waste toner 82*b* to draft photoconductor 102, and in particular, onto the latent image formed on draft photoconductor 102. The negatively charged waste toner 82*b* is electrostatically transferred onto transfer mechanism 24, which is charged at a polarity opposite of the waste toner 82*b*. For example, where the waste toner 82*b* has a negative charge, transfer mechanism 24 is charged to have a positive charge. In this manner, waste toner 82*b* is deposited onto and attracted by transfer mechanism 24 for delivery of an image to print medium 36, in accordance with transfer process 80 illustrated in FIG. 2.

In one embodiment, waste toner 82*b* attaches to transfer mechanism 24 and traverses at least a portion of the circuit or loop of transfer mechanism 24 before being charged to an opposite polarity from toner 82 that was delivered from draft developer 104; waste toner 82*b* is subsequently electrostatically picked up by draft photoconductor 102 for delivery to hopper 110. In one embodiment, hopper 110 is configured to accumulate waste toner 82*b* and transfer a portion of the waste toner 82*b* into draft developer 104 for subsequent image printing.

In one embodiment, hopper 110 communicates with draft developer 104 and is configured to transport waste toner 82*b* from hopper 110 into draft developer 104 in a manner that configures waste toner 82*b* for printing of images. One suitable mechanism for transporting waste toner 82*b* from hopper 110 to draft developer 104 includes an auger 114 extending between hopper 110 and draft developer 104, for example behind draft photoconductor 102 in the illustration of FIG. 3.

In one embodiment, hopper 110 includes a sensor 120 configured to sense a volume of waste toner 82*b* within hopper 110. In one embodiment, sensor 120 is electrically connected with the auger or other transport device, and initiates movement of the transport device to move collected waste toner 82*b* from hopper 110 into draft developer 104.

By the embodiments described above, draft photoconductor 102 is configured to receive a draft latent image from laser 112 and draft developer 104 is configured to deliver waste toner 82*b* onto the draft latent image for development of a draft image onto print medium 36.

In one embodiment, cleaner assembly 28 includes a transfer bias 130 that is configured to enable the selective delivery of waste toner 82*b* into hopper 110, or alternatively, to one of the other developer assemblies 50, 60, 70, 22 (FIG. 1). Thus, embodiments of transfer bias 130 provide for the selective pickup and retention of waste toner 82*b* into hopper 110, or the selective bypass of waste toner 82*b* downstream to the other developer assemblies 50, 60, 70, 22.

For example, in one embodiment transfer bias 130 is employed to impart a negative charge to transfer mechanism 24 such that waste toner 82*b* is attracted to transfer mechanism 24 and is discouraged or prevented from entering hopper 110. Waste toner 82*b* electrostatically attracted to transfer mechanism 24 is delivered to one of the other developer assemblies 50, 60, 70, 22 and is suited for use as a lubricant or image-printing toner.

In one embodiment, each of the developer assemblies 50, 60, 70, 22 includes its own transfer bias that is configured to change the polarity of that portion of transfer mechanism 24 to enable waste toner 82*b* to be picked up by one of the photoconductors 52, 62, 72, 32, or alternatively, to be bypassed to another of the developer assemblies by charging waste toner 82*b* to a state that electrostatically attracts waste toner 82*b* onto transfer mechanism 24.

In another embodiment, transfer bias 130 is employed to impart a positive charge to transfer mechanism 24 such that waste toner 82*b* is expelled away from transfer mechanism 24 toward one of the photoconductors 32, 52, 62, 72 (FIG. 1).

Figure 4:
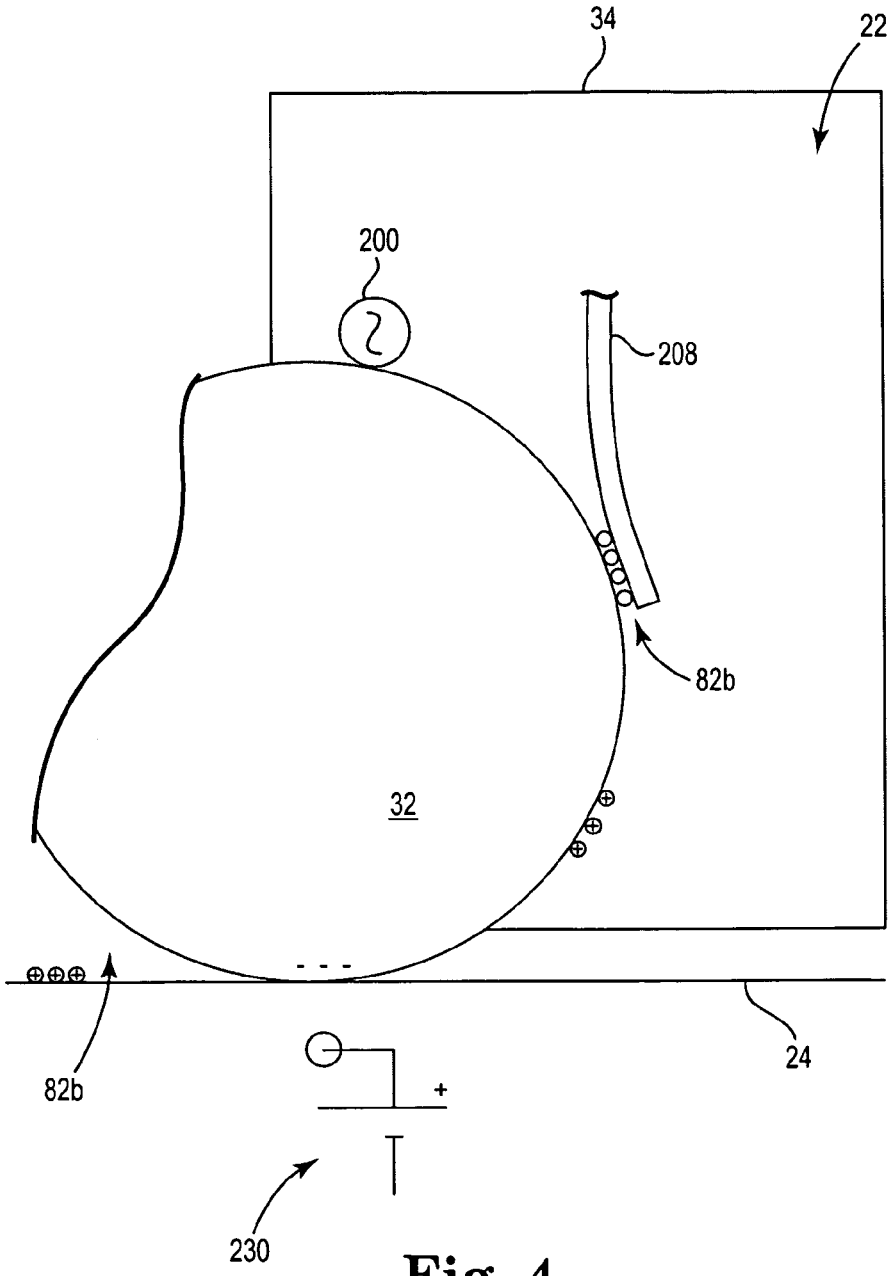
FIG. 4 is a schematic cross-sectional view of a cleaner blade of a developer assembly as employed by the image printing system of FIG. 1 according to one embodiment.

FIG. 4 is a schematic cross-sectional view of developer assembly 24 configured to receive waste toner 82*b* transferred from cleaner assembly 28 (FIG. 1 In one embodiment, waste toner 82*b* is selectively transferred along transfer mechanism 24 from cleaner assembly 28 toward photoconductor 32 of developer assembly 22. In one embodiment, photoconductor 32 is charged to a negative state and configured to electrostatically attract or pick up waste toner 82*b* that is maintained at a positive charge on transfer mechanism 24. For example, in one embodiment, developer assembly 22 includes a separate transfer bias 230 configured to establish a polarity on transfer mechanism 24 that causes waste toner 82*b* to be expelled toward photoconductor 32. Waste toner 82*b* attaches to photoconductor 32 (or is electrostatically attracted to photoconductor 32) and is cleaned off of photoconductor 32 by cleaning blade 208.

In one embodiment, a portion of waste toner 82*b* is captured between and employed to lubricate the interface between cleaner blade 208 and photoconductor 32. For example, in one embodiment cleaner blade 208 is formed of a polymer and is configured to skive collected toner off of photoconductor 32. In the absence of lubrication, cleaner blade 208 could possibly deform (e.g., tuck under or rotate clockwise relative to the illustration of FIG. 4) and initiate a failure of developer assembly 22. However, waste toner 82*b* can be effectively transferred from cleaner assembly 28 by the progressive transfer bias described above to the cleaner blade within one or all of developer assemblies 50, 60, 70, 22 (FIG. 1). Lubrication of cleaner blade 208 with waste toner 82*b* advantageously configures photoconductor 32 for repeated cycling and printing of images within image printing system 20.

In one embodiment, cleaner assembly 28 is configured to print images using waste toner 82*b*. With additional reference to FIGS. 1 and 3, in one embodiment developer assembly 22 is configured to deliver black toner employed to develop a monochrome image. In one embodiment, draft developer 104 of cleaner assembly 28 is configured to deposit or layer waste toner 82*b* over the black toner delivered from the black developer assembly 22. In this manner, waste toner 82*b* is layered over (e.g., over on the print medium or under on the transfer mechanism) the monochrome image developed from developer assembly 22, which results in forming darker, richer text or characters. In one embodiment, this "layering" or overprinting results in highlighting portions of the monochromatic image due to the variation in the color(s) of the toner in the waste toner 82*b*.

In one embodiment, by using waste toner 82*b* to print images, toner savings are realized since only a portion of "virgin" toner is utilized and augmented by a portion of waste toner 82*b*. The toner savings advantageously benefit from added utility in printing dark full characters sometimes desired by customers. In one example, seventy percent of virgin toner is co-mingled with thirty percent waste toner 82*b* to derive dark full characters on print medium 36.

With additional reference to FIG. 1, in one embodiment waste toner 82*b* is developed at cleaning station 30 and subsequently moved to one of the other developers 50, 60, 70, or 22 for lubrication. For example, in one embodiment draft photoconductor 102 is exposed with a selected pattern (e.g., a solid pattern), and transfer bias 230 of one or more of the other developers 50, 60, 70, 22 is switched to positive in order to repel the draft image formed of waste toner 82*b* from transfer mechanism 24 onto the various photoconductors 52, 62, 72, 32. As an example, the waste toner 82*b* is configured to pass the yellow station by setting the transfer bias 230 positive, and the transfer bias 230 of the magenta station is selectively set to negative to move the draft toner to the magenta photoconductor. One embodiment provides setting the transfer bias 230 to zero and having a portion of the waste toner 82*b* move to the photoconductor.

In one embodiment, the waste toner 82*b* is employed to produce a fuser cleaning page. For example, a page is printed with a heavy toner print pattern and run through fuser 43 (FIG. 1) while setting the engine controls of system 20 to maximize the cleaning properties of system 20.

In one embodiment, a toner level sensor 122 (FIG. 3) similar to sensor 120 is provided in developer 104 of draft cartridge 28 and configured to prevent over filling of developer 104 with waste toner 82*b*. In one embodiment, hopper sensor 120 is disposed in hopper 110 and in communication with toner level sensor 122 disposed in developer 104 such that the sensors are configured to selectively transfer waste toner 82*b* between hopper 110 and developer 104. In combination with hopper sensor 120, the additional sensor (i.e., toner level sensor 122) enables notification of the user when the draft station is full and is ready to be replaced with another draft cartridge. Alternatively, waste toner 82*b* is re-directed to one or more of the other developers 50, 60, 70, 22.

Figure 5:
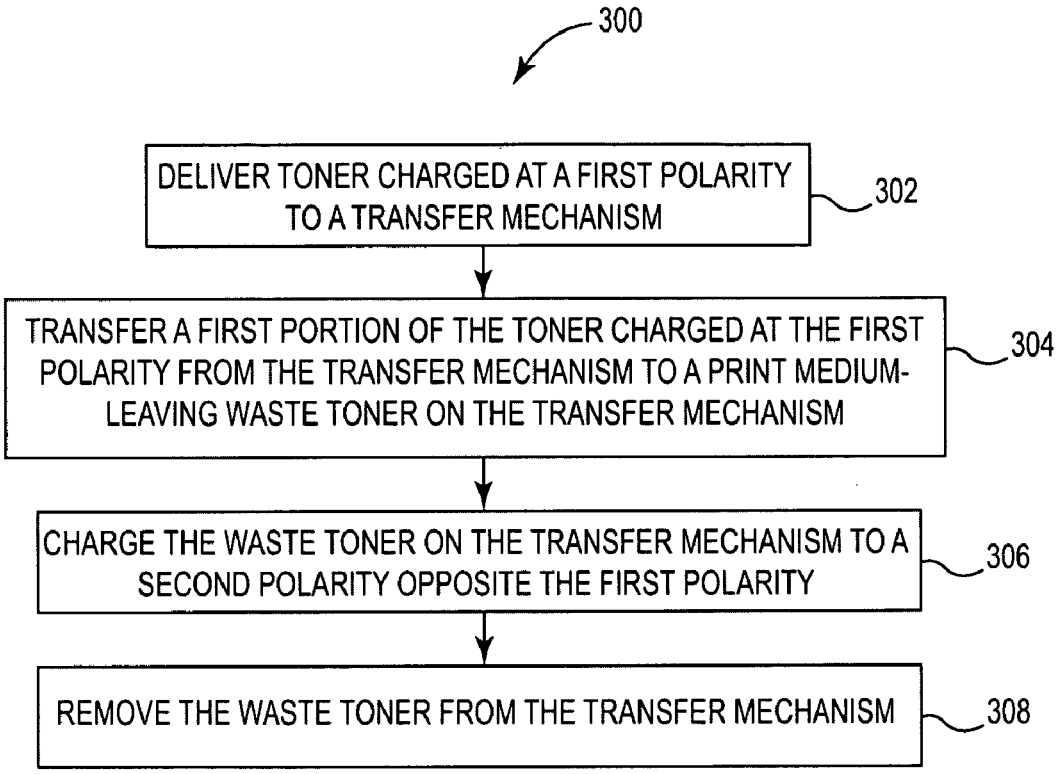
FIG. 5 is a flow diagram of a process for removing waste toner from a transfer mechanism according to one embodiment.

FIG. 5 is a flow diagram of a process 300 for cleaning a transfer mechanism of an image forming system according to one embodiment. Process 300 includes delivering toner charged at a first polarity to a transfer mechanism at 302. At 304, process 300 includes transferring a first portion of the toner charged at the first polarity from the transfer mechanism to a print medium—leaving waste toner on the transfer mechanism. At 306, process 300 includes charging the waste toner on transfer mechanism to a second polarity that is opposite the first polarity. At 308, process 300 includes removing the waste toner from the transfer mechanism.

In one embodiment, removing the waste toner from the transfer mechanism of process 300 includes attracting the waste toner charged at the second polarity with a draft photoconductor charged at the first polarity. For example, with additional reference to FIG. 3, waste toner 82*b* is attracted onto draft photoconductor 102 and stored and collected within hopper 110.

In one embodiment, removing the waste toner from the transfer mechanism of process 300 includes charging at least a portion of the transfer mechanism to the first polarity, which attracts the waste toner charged at the second polarity onto the transfer mechanism. Thereafter, the waste toner is selectively transported along the transfer mechanism to one of the other developer assemblies 50, 60, 70, 22 (FIG. 1) for use as lubrication. In one embodiment, one of the developers 50, 60, 70, 22 is moved to the cleaning station 30 to enable imaging with the waste toner.

Figure 6:
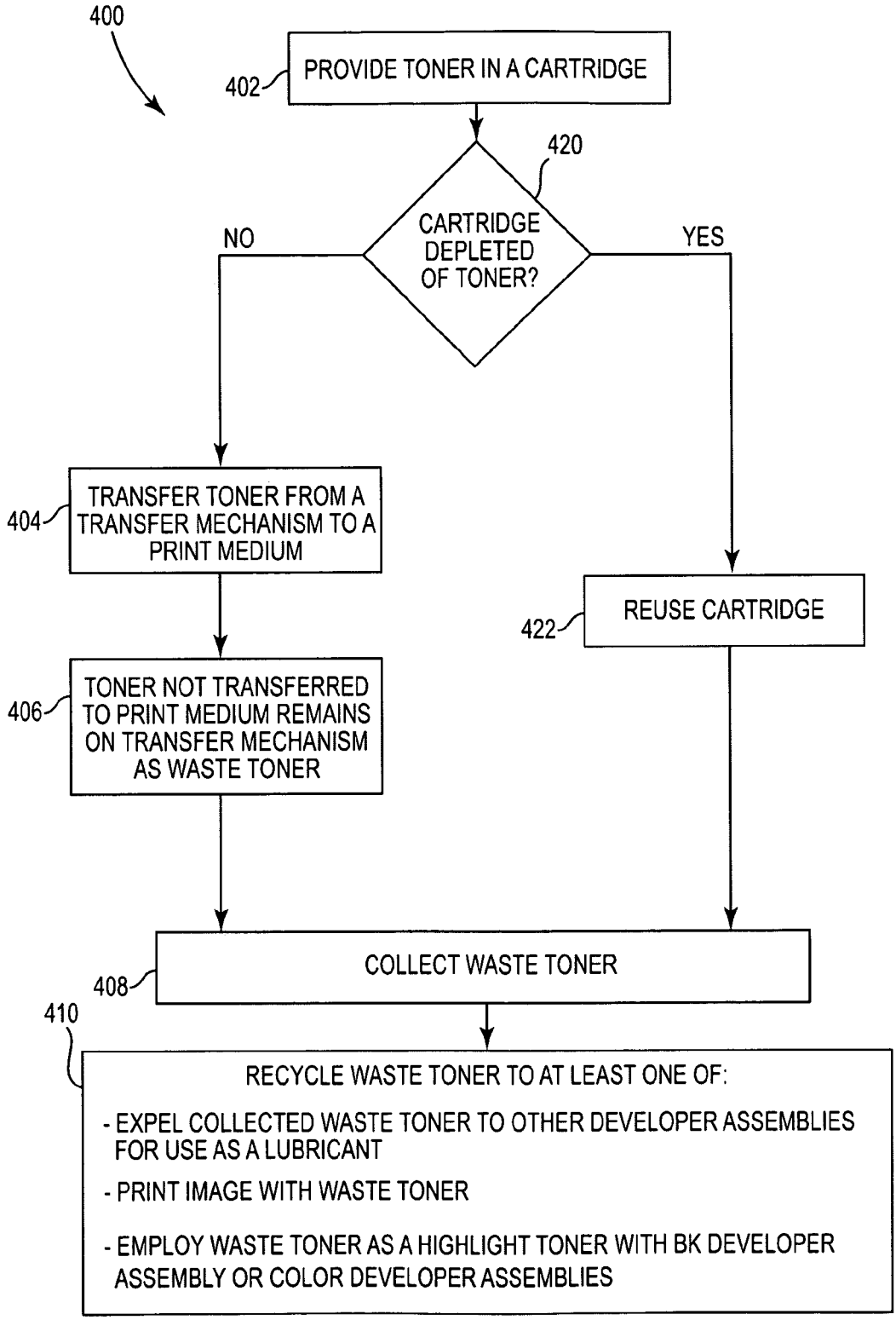
FIG. 6 is a flow diagram of a process for collecting and recycling waste toner in an image printing system according to one embodiment.

FIG. 6 is a flow diagram of a process 400 for recycling waste toner according to one embodiment. Process 400 includes providing toner in a cartridge at 402. At 404, process 400 includes transferring toner from a transfer mechanism to a print medium. At 406, process 400 includes a recognition that toner not transferred to print medium remains on the transfer mechanism as waste toner. At 408, process 400 includes collecting the waste toner. At 410, process 400 includes recycling the waste toner.

At 410, in one embodiment the waste toner is recycled and/or reused in at least one of the following ways: the waste toner is expelled to other developer assemblies for use as a lubricant; or the waste toner is recycled/reused by printing images with the waste toner; or the waste toner is recycled/reused by employing the waste toner as a highlight toner with toner developed from a black developer assembly or a color developer assembly.

It is to be recognized that the cartridge that contains the waste toner may become depleted. With this in mind, process 400 includes recognizing that the cartridge may become depleted of toner at 420. When a cartridge becomes depleted of toner, process 400 includes reusing the cartridge at 422. In one embodiment, the cartridge depleted of virgin toner is nearly empty and is reused by inserting the depleted cartridge into cleaner assembly 28 (FIG. 1) and employing the depleted cartridge to collect waste toner, for example as depicted at 408. If the cartridge is not depleted of toner, process 400 includes transferring toner from a transfer mechanism to a print medium at 404 through the use of the cartridge in accordance with the embodiments described herein.

Embodiments provide a cleaner assembly for use with an image printing system. In one embodiment, the cleaner assembly is configured to reclaim unused toner or waste toner form a transfer mechanism and recycle or re-use the reclaimed toner for printing images. In one embodiment, the cleaner assembly is configured to reuse waste toner by transporting the waste toner and employing it as a lubricant for lubricating other components in the image printing system.

Although specific embodiments have been illustrated and described herein, it will be appreciated by those of ordinary skill in the art that a variety of alternate and/or equivalent implementations may be substituted for the specific embodiments shown and described without departing from the scope of the present invention. Therefore, it is intended that this invention be limited only by the claims and the equivalents thereof.

What is claimed is:

1. A cleaning station for an image forming apparatus having a plurality of developer assemblies each including a developer assembly developer and a developer assembly photoconductor, the developer assembly developer configured to deliver toner of a first polarity to a latent image formed on the developer assembly photoconductor, the cleaning station comprising:

a transfer mechanism configured to transfer the toner of the first polarity from the latent image to a print medium;

a charging station configured to charge waste toner comprising toner not transferred from the transfer mechanism to the print medium to a second polarity opposite the first polarity; and a cleaner assembly configured to collect the waste toner from the transfer mechanism and subsequently transport the collected waste toner to at least one of the plurality of developer assemblies, the cleaner assembly comprising:

a cleaner assembly photoconductor configured to contact the transfer mechanism and remove the waste toner from the transfer mechanism;

a hopper configured to collect the waste toner from the cleaner assembly photoconductor; and a cleaner assembly developer configured to receive the waste toner from the hopper.

2. The cleaning station of claim 1, wherein the cleaner assembly photoconductor is configured to receive a draft latent image and the cleaner assembly developer is configured to deliver the waste toner to the draft latent image for development of a draft image.

3. The cleaning station of claim 1, wherein the cleaner assembly is configured to transfer the collected waste toner to an interface between a cleaning blade and a photoconductor of the at least one of the plurality of developer assemblies.

4. An image printing system, comprising:

at least one developer assembly comprising a developer assembly photoconductor configured to receive a latent image and a developer assembly developer configured to deliver toner of a first polarity to the latent image formed on the developer assembly photoconductor;

a transfer mechanism configured to transfer the toner of the first polarity from the latent image to a print medium;

a charging station configured to charge waste toner comprising toner not transferred from the transfer mechanism to the print medium to a second polarity opposite the first polarity; and a cleaner assembly comprising:

a cleaner assembly photoconductor configured to contact the transfer mechanism, remove the waste toner from the transfer mechanism, and deposit the waste toner in a hopper; and a hopper sensor disposed in the hopper and in communication with a developer sensor disposed in a cleaner assembly developer, the sensors configured to selectively transfer the waste toner between the hopper and the cleaner assembly developer.

5. The image printing system of claim 4, wherein the cleaner assembly further comprises a transfer bias configured to charge a portion of the transfer mechanism such that the waste toner is attracted to the transfer mechanism for delivery to one of multiple developer assemblies of which the at least one developer assembly is included.

6. The image printing system of claim 5, wherein the waste toner is attracted to the transfer mechanism and transferred to the developer assembly photoconductor of the at least one developer assembly.

7. The image printing system of claim 5, wherein the waste toner from the hopper is transferred to the transfer mechanism for delivery to one of the multiple developer assemblies.

8. The image printing system of claim 4, wherein the at least one developer assembly comprises a black developer assembly configured to deliver black toner for development of a monochrome image, and the cleaner assembly photoconductor is configured to deliver waste toner over the black toner and overprint at least a portion of the monochrome image.

9. A method of cleaning a transfer mechanism of an image forming system, the method comprising:

delivering toner charged at a first polarity to the transfer mechanism;

transferring a first portion of the toner charged at the first polarity from the transfer mechanism to a print medium and leaving waste toner on the transfer mechanism;

charging the waste toner on the transfer mechanism to a second polarity opposite the first polarity; and removing the waste toner from the transfer mechanism, wherein removing the waste toner from the transfer mechanism comprises one of:

developing an image with the waste toner and moving at least a portion of the image to another developer; and printing a fuser cleaning page with the waste toner.

10. The method of claim 9, wherein removing the waste toner from the transfer mechanism comprises attracting the waste toner charged at the second polarity with a draft photoconductor charged at the first polarity.

11. The method of claim 9, wherein removing the waste toner from the transfer mechanism comprises:

charging at least a portion of the transfer mechanism to the first polarity;

attracting the waste toner charged at the second polarity to the portion of the transfer mechanism charged to the first polarity; and delivering the waste toner to a developer assembly of the image forming system.

12. The method of claim 9, wherein developing an image comprises highlighting portions of a monochromatic image by layering the waste toner over black toner.

* * * * *